US006443785B1

(12) United States Patent
Swartz et al.

(10) Patent No.: US 6,443,785 B1
(45) Date of Patent: Sep. 3, 2002

(54) METHOD AND APPARATUS FOR SELF-DEPLOYING RUDDER ASSEMBLY

(76) Inventors: Jeffrey B. Swartz, 8070 Pimlico La., Fair Oaks Ranch, TX (US) 78015; Barry E. Swartz, 8070 Pimlico La., Fair Oaks Ranch, TX (US) 78015

( * ) Notice: Subject to any disclaimer, the term of this patent is extended or adjusted under 35 U.S.C. 154(b) by 0 days.

(21) Appl. No.: 09/738,451

(22) Filed: Dec. 15, 2000

(51) Int. Cl.[7] ..... B63H 11/107
(52) U.S. Cl. ..... 440/40; 114/162; 440/43
(58) Field of Search ..... 440/40, 42, 43; 114/162, 165

(56) References Cited

U.S. PATENT DOCUMENTS

| | | | | |
|---|---|---|---|---|
| 3,949,700 A | 4/1976 | Baroody | ..... | 115/12 R |
| 3,976,076 A | 8/1976 | Beach | ..... | 128/295 |
| 3,982,494 A | 9/1976 | Posti | ..... | 115/12 R |
| 4,779,553 A | 10/1988 | Wildhaber, Sr. | ..... | 114/151 |
| 5,167,547 A | 12/1992 | Kobayashi et al. | ..... | 440/42 |
| 6,086,437 A | 7/2000 | Murray | ..... | 440/43 |

FOREIGN PATENT DOCUMENTS

| | | | | |
|---|---|---|---|---|
| JP | 5-162689 | * 6/1993 | ..... | 440/43 |
| JP | 283593 | 11/1999 | | |

* cited by examiner

*Primary Examiner*—Sherman Basinger
(74) *Attorney, Agent, or Firm*—Jenkens & Gilchrist, A Professional Corporation

(57) ABSTRACT

A self-deploying rudder assembly for use with a water craft including an exhaust port having a exhaust stream includes a mounting assembly and a pivoting rudder blade assembly. The pivoting rudder blade assembly typically includes a thrust plate attached to one end of a rudder shaft and a rudder blade attached to the other end of the rudder shaft. When the selected thrust level is above the preselected thrust level, the thrust plate is moved out of the exhaust stream and the rudder blade is thereby moved from a deployed, operational position to a stored position.

15 Claims, 8 Drawing Sheets

METHOD AND APPARATUS FOR SELF-DEPLOYING RUDDER ASSEMBLY

BACKGROUND OF THE INVENTION

1. Technical Field

This invention relates generally to water craft and rudder/steering devices. More particularly, the invention relates to self-deploying rudder devices which respond to fluid flow pressure, such as that provided by the exhaust from jet-propelled water craft.

2. History of Related Art

Jet-propelled water craft are typically designed to be steered using exhaust fluid flow pressure developed from a movable jet nozzle submerged below the surface of the water. However, as the throttle-controlled thrust is retarded, the ability to steer is substantially reduced. In fact, since most jet-propelled water craft have no rudders, any type of substantial reduction in exhaust pressure, coupled with a steering capability that depends upon a steerable exhaust nozzle, typically makes it impossible to steer such water craft effectively.

Various mechanisms have been developed to provide alternative steering capability for jet-propelled water craft. However, such mechanisms have many shortcomings. For example, some rudder mechanisms require manual operation to deploy into the water, or to be removed from the water. Spring-biased rudder mechanisms, while providing the ability to displace upwardly upon contact with foreign objects, typically remain in the water at all times, producing excessive drag during high-speed operation of the water craft. Finally, some of these mechanisms are designed to deploy automatically, but when stored, trail behind the water craft above the water line. Thus, such devices present a significant safety hazard to anyone falling off of the water craft during use.

Other attempts to deal with the problem of providing slow speed steering control to jet-powered water craft in a safe and efficient manner include the use of a third class lever connected to a rudder, which pivots from the uppermost portion of the lever, where it is attached to the jet nozzle. Thus, the rudder extends behind the craft for some distance while deployed in the steering position, and extends both behind the craft and above the water line while in the stowed, or "running" mode. Such operational characteristics present a significant hazard to any operator, or passenger of the water craft that falls to the rear of the craft during operation. Further, re-boarding of the craft after a fall is quite difficult if the rudder apparatus projects into the path of the boarding operator and/or passenger.

Such devices do not allow for adjustments in the level of thrust required to deploy and/or store the rudder based on the exhaust pressure developed at idle speed, nor do such devices allow for raising the rudder completely out of the way for beaching/launching the water craft. Finally, such devices do not provide any type of stabilizing force for the stored rudder blade during powered operation.

Thus, what is needed is a rudder assembly for use with an exhaust port which operates to automatically deploy the rudder below a selected exhaust thrust level and which operates automatically to store the rudder when the thrust level is above the preselected level. Of course, such a device would be even more useful if it provided the option for manual deployment and storage. Finally, such a device would be most useful if automatic operation could be adjusted to occur at some variable level of thrust, selected by the user.

SUMMARY OF THE INVENTION

The self-deploying rudder assembly of the present invention includes a mounting assembly which attaches to an outlet nozzle, or exhaust port, such as those used on jet-propelled water craft. The self-deploying rudder assembly also includes a thrust plate, rudder shaft, and rudder blade, which are typically integrated into a single unit called the rudder blade assembly. The rudder blade attaches to one end of the rudder shaft, and the thrust plate attaches to the other end. The shaft typically operates as a first class lever, having a rudder pivot point, or fulcrum, located between the thrust plate and the rudder blade. A deployment means, such as a spring, is attached to the shaft and the mounting assembly so as to bias the rudder blade in a downward, fully-deployed position, to allow steering the water craft at low levels of thrust. The thrust plate intercepts the exhaust from the exhaust port and operates to urge the rudder blade into a stored position when the thrust level selected by the operator of the water craft is above some preselected thrust level. That is, when the water craft operator increases the amount of throttle to the jet, so the craft moves forward at high speed, the rudder blade will be stored underneath the water craft, typically in a grooved skeg. However, when the throttle is rolled off and the water craft is operated at a low speed, the rudder will be deployed (using the deployment means) into an operative position. The thrust plate may include an adjustable cross-sectional surface area, or an orifice, which allows selection of the low speed threshold for rudder deployment and storage.

An alternative embodiment of the invention divides the rudder shaft into two portions, an upper shaft and a lower shaft. The upper shaft engages the lower shaft in a continuous fashion using a gear attached to each of the shafts, such that the upper shaft and an attached or integral gear is continuously engaged with a lower shaft gear, which is integral with, or attached to, the lower shaft. Alternatively, a pushrod assembly can be attached to the upper and lower shafts so that movement out of the exhaust stream by the upper shaft causes direct movement and storage of the lower shaft and rudder blade. In this case, the rudder shaft no longer operates as a first class lever; however, all of the other advantages of the invention are retained. In addition, at high operating speeds, the rudder blade folds toward the rear of the craft for storage. This allows the fluid forces exerted against the rudder blade during high speed operations to assist retention of the rudder blade when it is stored within the grooved skeg.

As a matter of increased utility, the self-deploying rudder assembly may incorporate a cable or other storage means which allows storage of the rudder unit for beaching and/or launching the water craft. The rudder assembly may also include a rotatable gear engaged to a gear rack which rotates the rudder blade as it moves toward a stored position such that the rudder blade is stored flush, and in the same plane, as the undersurface of the water craft hull.

Dual-shaft, rudder blade combinations can also be used. The use of additional rudder blade area, such as may occur with dual rudders, increases the ability to steer the water craft during conditions of low or no thrust.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
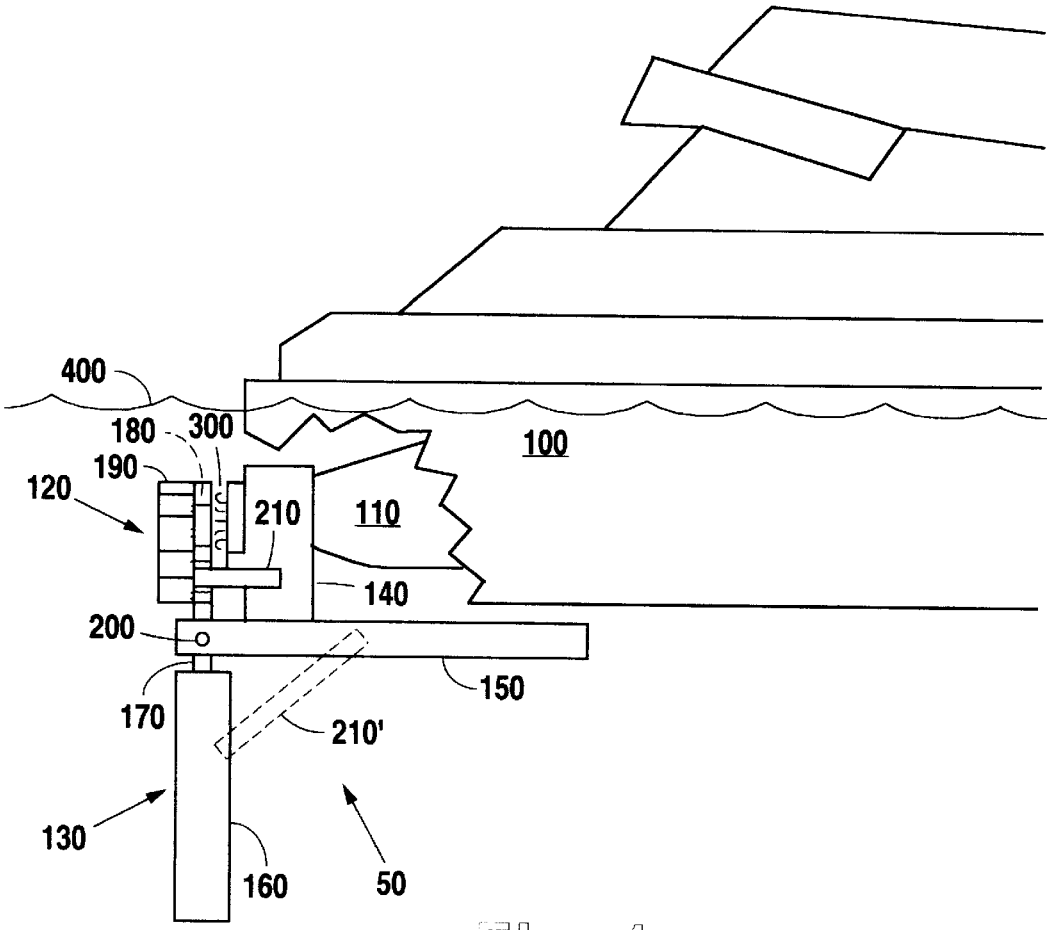
FIG. 1 is a side view of the self-deploying rudder assembly of the present invention, showing the rudder in a deployed position.

As mentioned above, jet-propelled water craft generally use a movable nozzle with an exhaust port to provide steering capability. Thus, as shown in FIG. 1, the water craft 100 is attached to the nozzle 110, which can be moved from side to side to direct the exhaust stream 300 and turn the water craft. Since the nozzle 110 is the only mechanism available for steering the water craft 100, when the thrust of the exhaust stream 300 falls below a preselected level, no steering is available to the operator of the water craft 100.

Figure 2:
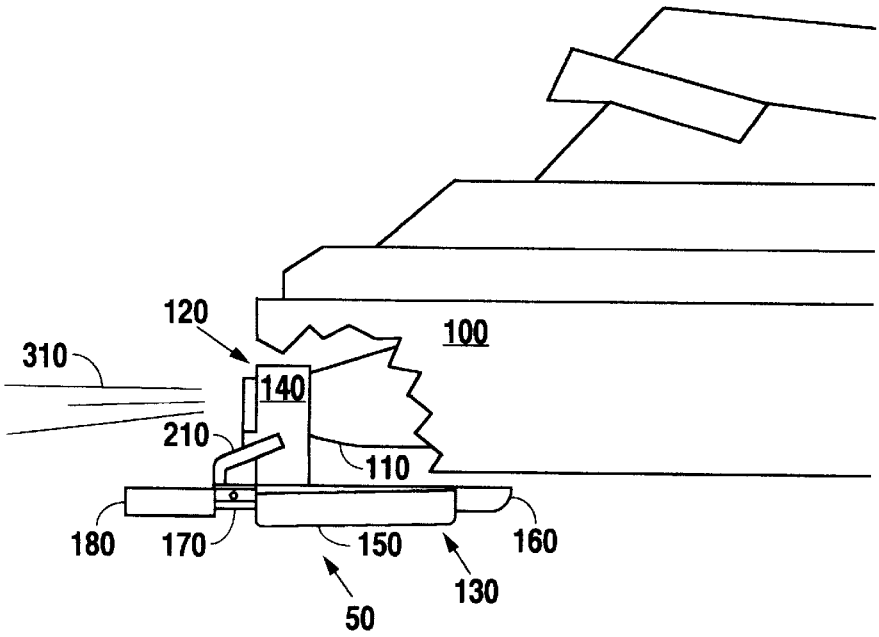
FIG. 2 is a side view of the self-deploying rudder assembly of the present invention, showing the rudder in a stored position.

The self-deploying rudder assembly 50 of the present invention provides steering control for the water craft 100 by deploying a rudder blade 160 into an operational position when the thrust level of the exhaust stream 300 falls below a preselected thrust level. However, as can be seen in FIG. 2, when the thrust level of the exhaust stream 310 rises above the preselected thrust level, the rudder blade 160 is moved to a stored position. At these higher thrust levels, the rudder blade 160 is no longer needed for steering control, since the control provided by the movable nozzle 110 is sufficient. The thrust level of the exhaust stream 300 is typically selected by operating a throttle control on the water craft.

The rudder assembly 50 includes a mounting assembly 120 for attaching the self-deploying rudder assembly 50 to the exhaust port or nozzle 110. The mounting assembly 120 may include a mounting ring 140 as a means of circular, removable attachment to the nozzle 110. Of course, the mounting assembly 120 may also be formed integrally with the nozzle 110 for non-removable attachment of the self-deploying rudder assembly 50 to the nozzle 110. Thus, the self-deploying rudder assembly 50 can be manufactured as an attachment to the nozzle 110 of the water craft 100, or as an integral portion of the nozzle 110, and sold as a part of the water craft 100. The rudder assembly 50 also includes a thrust plate 180 which is attached to the first end of a rudder shaft 170; the rudder blade 160 is attached to the second end of the rudder shaft 170. There is a fulcrum, or rudder pivot 200, which is attached to the mounting assembly 120 and pivotally attached to the rudder shaft 170 between the first end of the rudder shaft 170 and the second end of the rudder shaft 170 (i.e. between the point where the thrust plate 180 is attached, and the point where the rudder blade 160 is attached). The combination of the thrust plate 180, the rudder shaft 170, and the rudder blade 160 make up the pivoting rudder blade assembly 130.

A deployment means 210, such as a spring, has a first end attached to the mounting assembly 120, and a second end attached to the rudder shaft 170. Any number of elastic devices, acting under tension, may be used for the deployment means to 210, including rubber bands, elastic cord, or other natural and/or synthetic elastic materials. The deployment means serves to pull the thrust plate 180 into position in line with the exhaust stream 300 during those times when the thrust level of the exhaust stream 300 is below the preselected thrust level. Alternatively, a deployment means 210' operating under compression, such as a spring, a shock absorbing piston, or some other device which operates to urge the rudder blade 160 into the deployed position during low thrust conditions may be used in place of the deployment means 210.

As seen in FIG. 2, the mounting assembly 120 includes the mounting ring 140 and the storage skeg 150. Thus, the self-deploying rudder assembly 50 can be said to include the mounting assembly 120 pivotally attached to the pivoting rudder blade assembly 130. This combination is realized when the mounting assembly 120 is manufactured as an integral unit, typically molded from high impact plastic, including the mounting ring 140 and the storage skeg 150. Similarly, the pivoting rudder blade assembly 130 can be constructed as a single unit including the thrust plate 180, the rudder shaft 170, and the rudder blade 160. The pivoting rudder blade assembly 130 can also be molded from high-impact plastic. Of course, any other suitable materials, such as metals, including aluminum, plastics, including polymers, ceramics, or even wood can be used to fabricate the mounting assembly 120, the pivoting rudder blade assembly 130, and their component elements. The rudder blade assembly 130 can be mounted to the mounting assembly 120 using a separately-manufactured rudder pivot 200, or may include the pivot/fulcrum function in the form of a snap together assembly, wherein holes are formed in either the mounting assembly 120 or the pivoting rudder blade assembly 130, and mated to complementary snap-in shafts or "ears" formed in the pivoting rudder blade assembly 130, and the mounting assembly 120, respectively.

As shown in FIG. 1, when the thrust level of the exhaust stream 300 is below the preselected thrust level, the deployment means 210 operates to pull the rudder blade assembly 130 into an upright position, which places the thrust plate 180 into the exhaust stream 300, in line with the nozzle 110. At this time, the rudder blade 160 is in a deployed position, upright in the water 400, and provides operational steering for the water craft 100 as the nozzle 110 is moved side to side by the water craft 100 operator.

Referring now to FIG. 2, wherein the exhaust stream 310 of the nozzle 110 has risen above the preselected thrust level, and provides sufficient force to overcome the tension of the deployment means 210, the rudder blade 160 moves into a stored position within the storage skeg 150. In the stored position, the rudder blade 160 is typically shielded or protected by a groove 155 (see FIG. 4) formed into the skeg 150.

In the deployed position (FIG. 1), the rudder blade 160 provides operational steering control to the operator of the water craft 100. In the stored position (FIG. 2), the rudder blade 160 is stored within the skeg 150 and does not impede the exhaust stream 310 flow from the nozzle 110. Operation of the self-deploying rudder assembly 50 is thus automatic, and depends only on the level of thrust selected by the operator for the exhaust stream 300, 310. Thus, the safety feature of low speed operational steering control is provided without the need for any conscious action on the part of the water craft operator. This feature should serve to reduce the danger of incidents which required immediate reduction in throttle application, combined with the need for steering control of the water craft 100.

Figure 3:
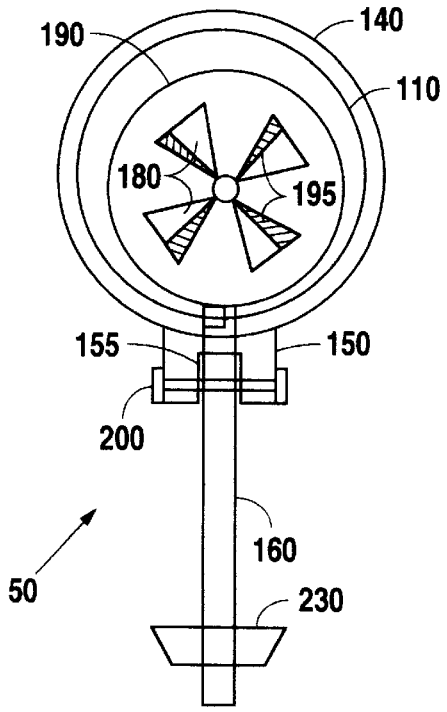
FIG. 3 is a front view of the self-deploying rudder assembly of the present invention, showing the rudder in a deployed position.
Figure 4:
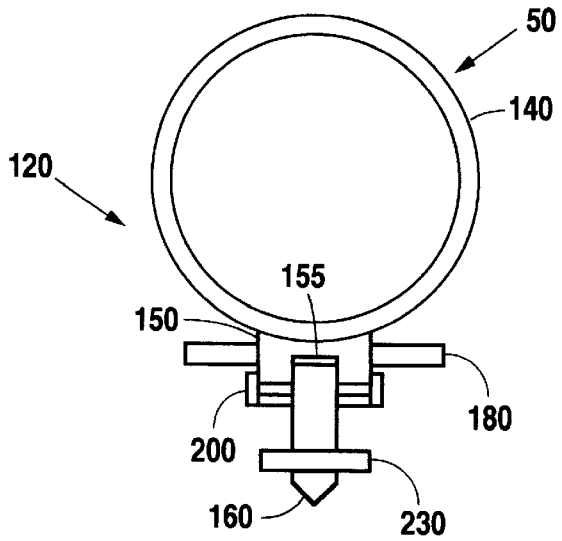
FIG. 4 is a front view of the self-deploying rudder assembly of the present invention, showing the rudder in a stored position.

Turning now to FIGS. 3 and 4, frontal views of the rudder blade in a deployed position, and a stored position, respectively, can be seen. In the deployed position (FIG. 3), the thrust plate (and optional thrust plate adjuster 190) can be seen as ready to intercept the exhaust stream which propagates through the mounting ring 140. In the stored position, the thrust plate 180 is moved out of the way of the exhaust stream which propagates through the mounting ring 140. Also shown in these views is a rudder blade plate 230 which can be molded into the rudder blade 160, or manufactured as a separate component. The rudder blade plate 230 provides added upward force to the rudder blade 160 when in the stored position, which tends to stabilize the rudder blade 160 as it rests within the groove 155 of the skeg 150. The added upward force provided by the rudder blade plate 230 is most useful during high speed runs and abrupt course change operations that are a normal part of water craft 100 operations. The rudder blade plate 230 can be seen more clearly from the side in FIG. 5.

Figure 5:
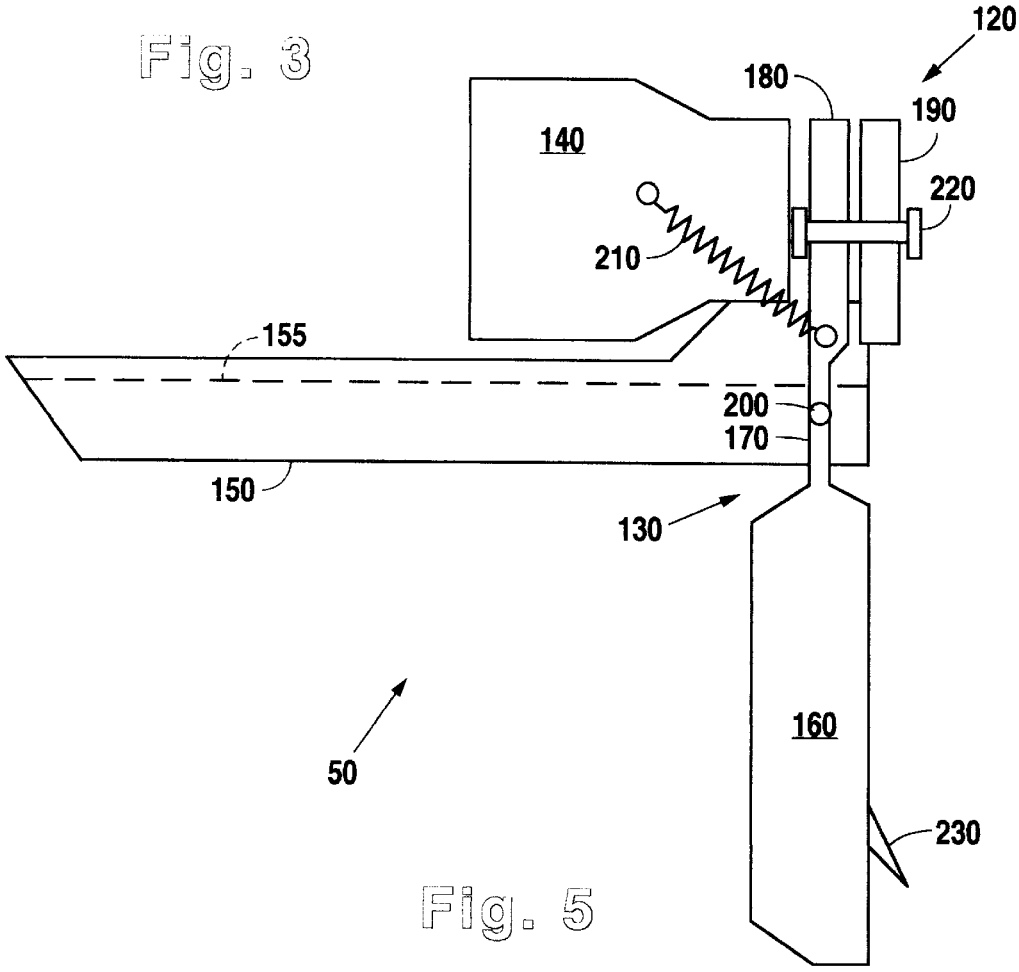
FIG. 5 is a side view of the self-deploying rudder assembly of the present invention.

Also apparent in FIG. 5 is the optionally-provided thrust plate adjuster 190, which is typically mounted to the thrust plate 180 using a thrust plate pivot 220. The thrust plate pivot 220 can be molded so as to form an integral part of the thrust plate 180, or the thrust plate adjuster 190, and attached to the mating component using a "snap-fit" through a hole in the mating component, as is well known to those skilled in the art.

Figure 6:
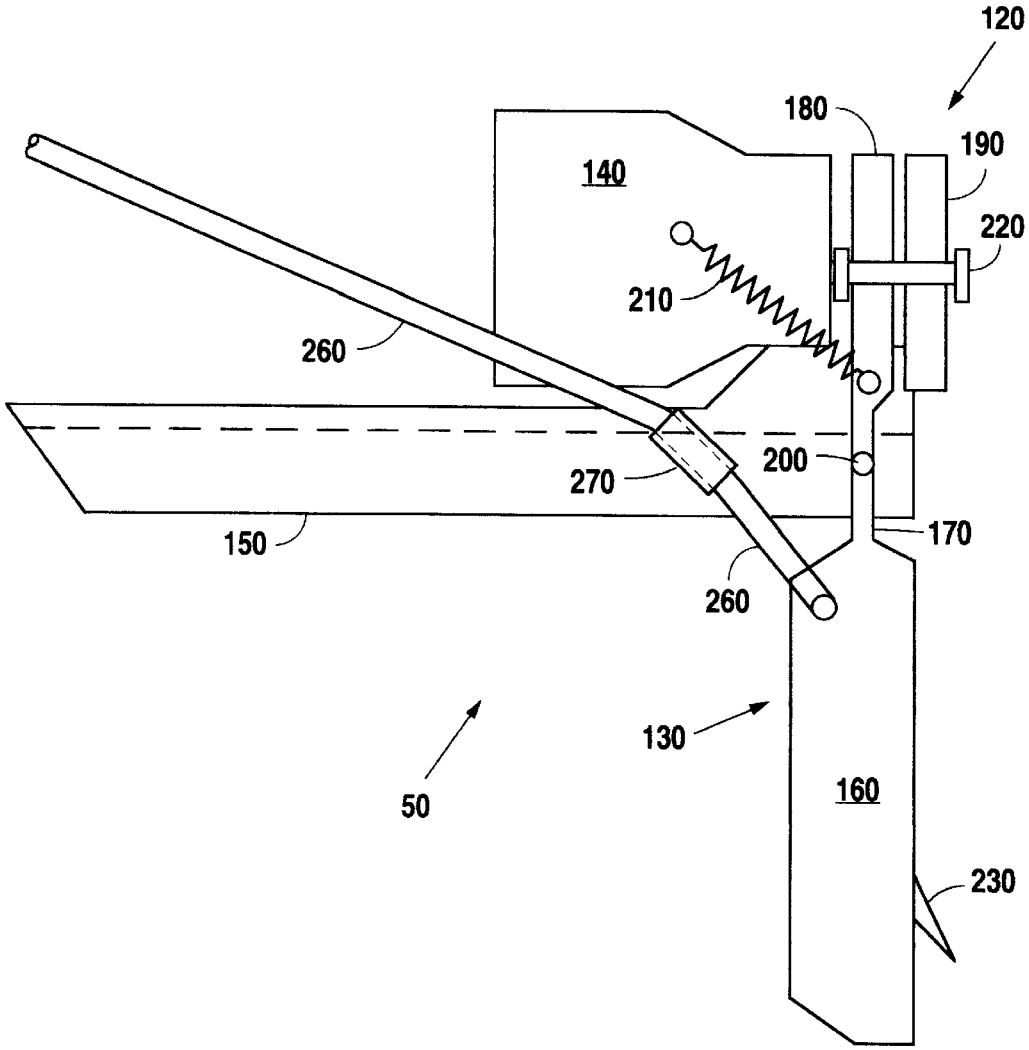
FIG. 6 is a side view of the self-deploying rudder assembly of the present invention including a storage means in the form of a cable.

Turning now to FIG. 6, the storage means 260, which typically takes the form of a cable, can be seen. The storage means 260 is normally attached to the pivoting rudder blade assembly 130, at some point along the rudder shaft 170, or the rudder blade 160. Of course, the storage means 260 may also be attached to the thrust plate 180, depending on the particular implementation of the design. If the storage means 260 is a cable, then a rudder cable mount 270 will usually be used to guide the storage means 260 along the path from the area of the self-deploying rudder assembly 50 to the operator. As shown, the storage means 260 is in the second operating position (which results in allowing the rudder blade to deploy).

The storage means 260 allows the water craft operator to raise and stow the rudder blade 160 during beaching, launching, or transportation of the water craft 100. The end of the storage means 260 which is not attached to the rudder blade 160 is typically guided through the rudder cable mount 270 up to the operator of the water craft, where it terminates in a "turn and lock" handle device (not shown) on the control panel of the water craft 100. When the operator pulls the handle (i.e. places the storage means 260 in a first operating position), the rudder blade 160 is manually rotated into the stored position. An electrically or hydraulically powered raising device can be used to place the rudder blade 160 into the stored position by operator command, as is well known to those skilled in the art.

Figure 7A:
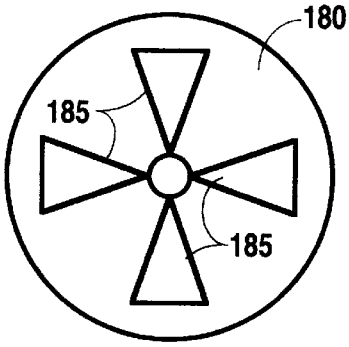
FIGS. 7A, 7B, and 7C are detailed views of the thrust plate, thrust plate adjuster, and the thrust plate joined to the thrust plate adjuster, respectively.
Figure 7B:
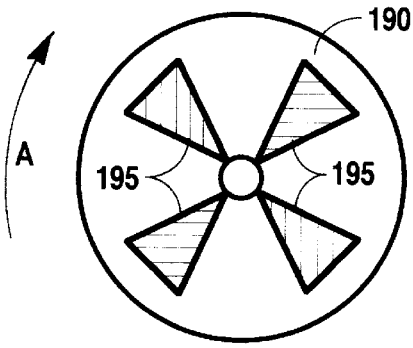
Figure 7C:
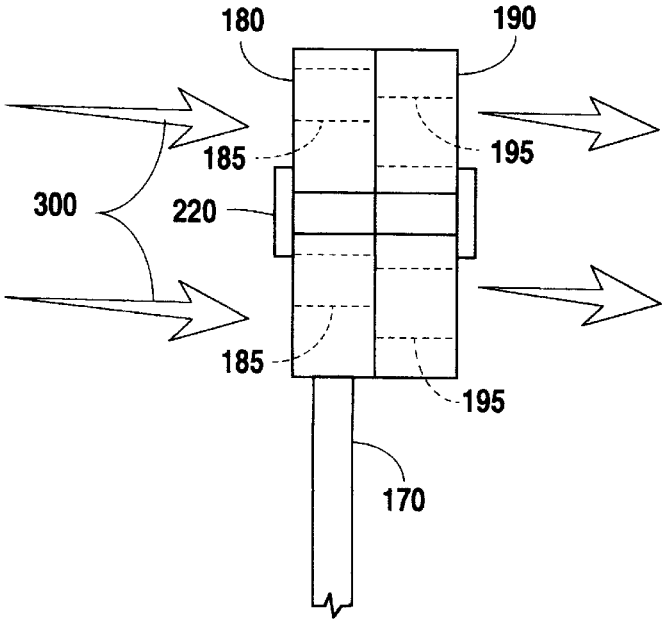

Turning now to FIGS. 7A, 7B and 7C, the details of the thrust plate 180, and thrust plate adjuster 190, can be seen. In the simplest implementation, the thrust plate 180 can be used alone as an element of the pivoting rudder blade assembly 130, as shown in FIGS. 2 and 4. In this case, the thrust plate 180 includes one or more thrust plate holes 185 to allow the passage of some selected amount of the exhaust stream 300, which prevents storage of the pivoting rudder blade assembly 130 until the selected thrust level of the exhaust stream 300 is above a preselected thrust level. The level of thrust required to rotate the pivoting rudder blade assembly 130 into the stored position thus depends upon the size of the thrust plate holes 185 in relation to the surface area of the thrust plate 180, along with the level of thrust present in the exhaust stream 300. In more complex implementations of the self-deploying rudder assembly 50 of the present invention, a thrust plate adjuster 190, having adjuster holes 195, can also be mounted in line with the exhaust stream 300 and the thrust plate 180, as shown in FIG. 7C. Using the thrust plate pivot 220, the thrust plate adjuster 190 can be rotated in the "A" direction to provide an orifice having a variable surface area (i.e. the "orifice" may include the combined surface area of the thrust plate holes 185, minus the area closed off by the thrust plate adjuster 190). Thus, by rotating the thrust plate adjuster 190 in the (A) direction, the thrust plate holes 185 can be completely open, or completely obscured, as desired by the operator. Thus, the thrust plate 180 can include at least one orifice having a variable surface area, in this fashion. As shown in the exemplary FIGS. 7A–7C, four orifices (or any desired number) having a variable surface area can be realized. Of course, as is well known to those skilled in the art, other methods of providing a variable orifice can be effected.

In relation to the maximum thrust level developed by the exhaust port (i.e., the selected thrust lever has a maximum thrust level) the user may select a thrust level for storage of the rudder of about 5% to 50% of the maximum level. However, it is preferred to select a thrust level between about 10% to 40% of the maximum thrust level, with an optimum selected thrust level for storage of about 20% of the maximum level. Similarly, the thrust plate may include an adjustable orifice, having a variable surface area, such that the rudder moves to a deployed position at some thrust level selected by the user. Thus, when the thrust level is below the pre-selected thrust level, the rudder deploys. The selected thrust level is typically between about 5% and 50% of the maximum thrust level, but may also be selected to be between about 10% to 20% of the maximum thrust level, and most preferably, to be about 20% of the maximum thrust level.

Figure 8:
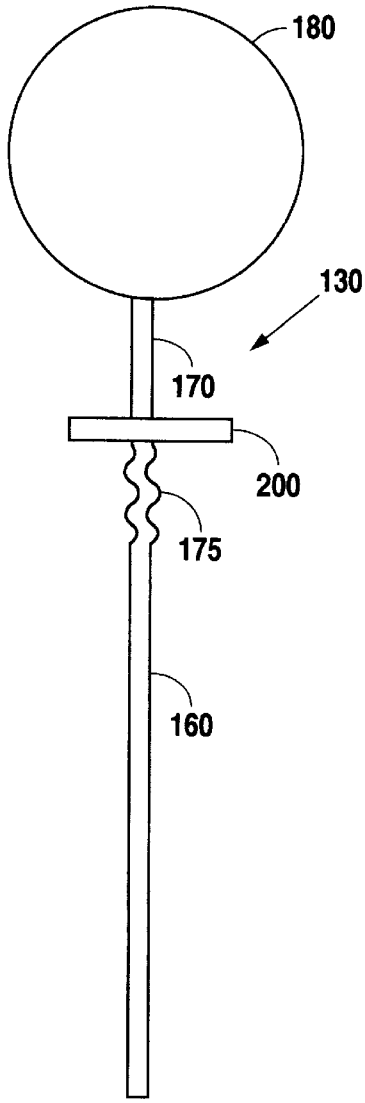
FIG. 8 is an alternative embodiment of the self-deploying rudder assembly of the present invention.

Turning now to FIG. 8, a pivoting rudder blade assembly 130, providing increased safety to operators and passengers, is shown. In this implementation of the pivoting rudder blade assembly 130, a flexible portion 175 of the rudder shaft 170 is used to protect the rudder blade 160 upon encountering some hard or immovable object. The rudder blade 160 in this case is allowed to move out of the way of such objects due to the flexible portion 175 action, which prevents breakage of the rudder blade 160 upon encountering underwater obstacles.

Figure 9:
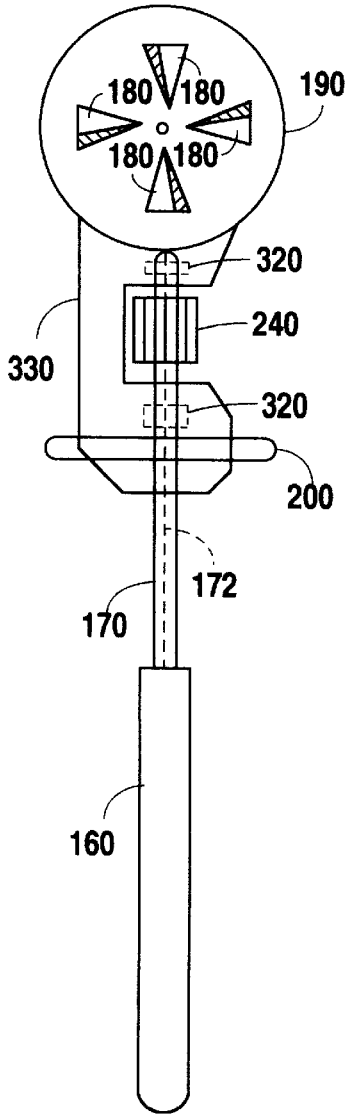
FIG. 9 is a frontal view of an alternative embodiment of the self-deploying rudder assembly of the present invention.
Figure 10:
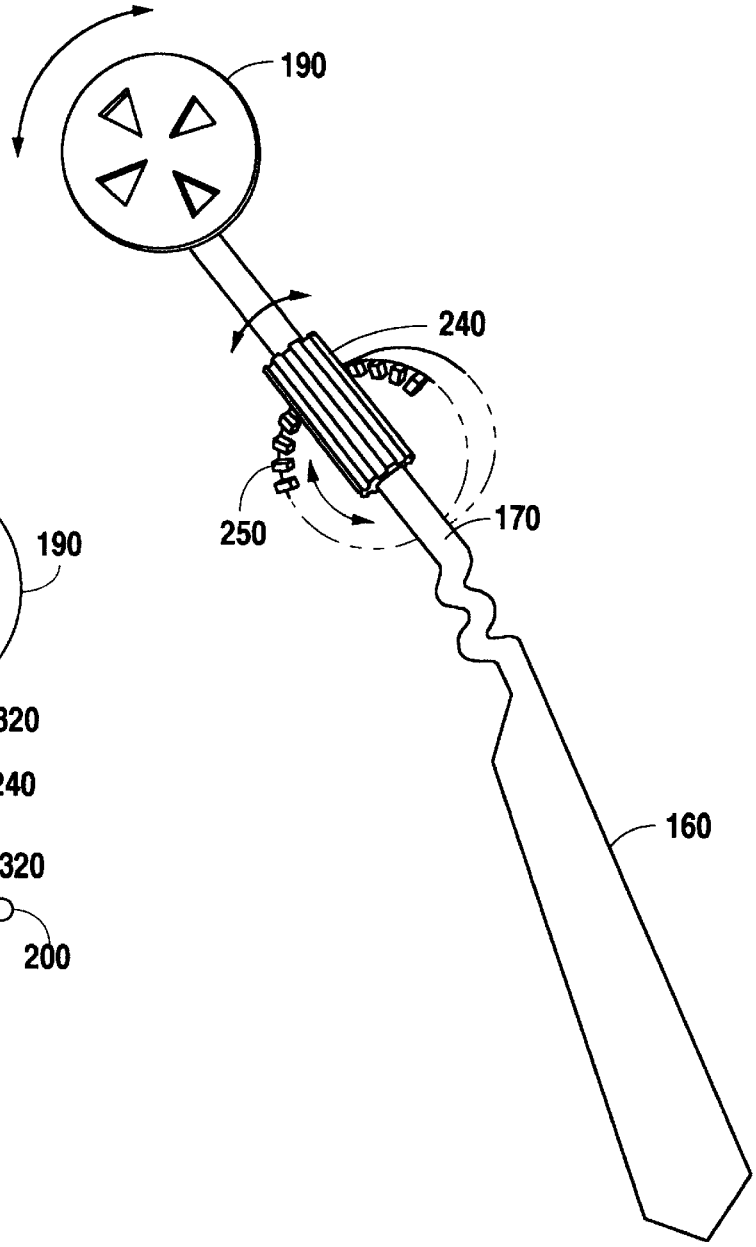
FIG. 10 is a side view of an alternative embodiment of the self-deploying rudder assembly of the present invention.

To provide increased design flexibility and safety, the embodiment of the self-deploying rudder assembly 50 shown in FIG. 9 can be used. In this instance, the entire rudder blade assembly 130 is designed to rotate 90° about the longitudinal axis 172 of the rudder shaft 170 at the same time the rudder blade 160 moves upward into the stored position when the thrust level selected by the operator is above the preselected thrust level set using the thrust blade adjuster 190. FIGS. 9 and 10 illustrate rotation of the rudder blade assembly 130 about the longitudinal axis 172 of the shaft 170 as a rudder shaft gear 240 attached to the rudder shaft 170 engages with the main body rudder gear rack 250. The rotational movement about the longitudinal axis 172 of the rudder shaft 170 allows the rudder blade 160 to be stowed in a flat, horizontal position against the skeg 150 of the water craft 100. In this stored position, the rudder blade 160 offers less resistance to the water during high speed operation of the water craft 100, and is better protected against shear forces. To secure the rudder blade assembly 130 for geared rotation, bushings 320, mounted to a rotational mounting plate 330, can be used. Of course, as is well known to those skilled in the art, other implementations for rotating the rudder blade assembly 130 are possible. If a rudder blade plate 230 (not shown) is mounted to the rudder blade 160 for this implementation of the invention, it must be repositioned to the side of the rudder blade 160 (i.e., parallel to the rudder blade 160, instead of perpendicular to the rudder blade 160) for effective use.

Figure 11:
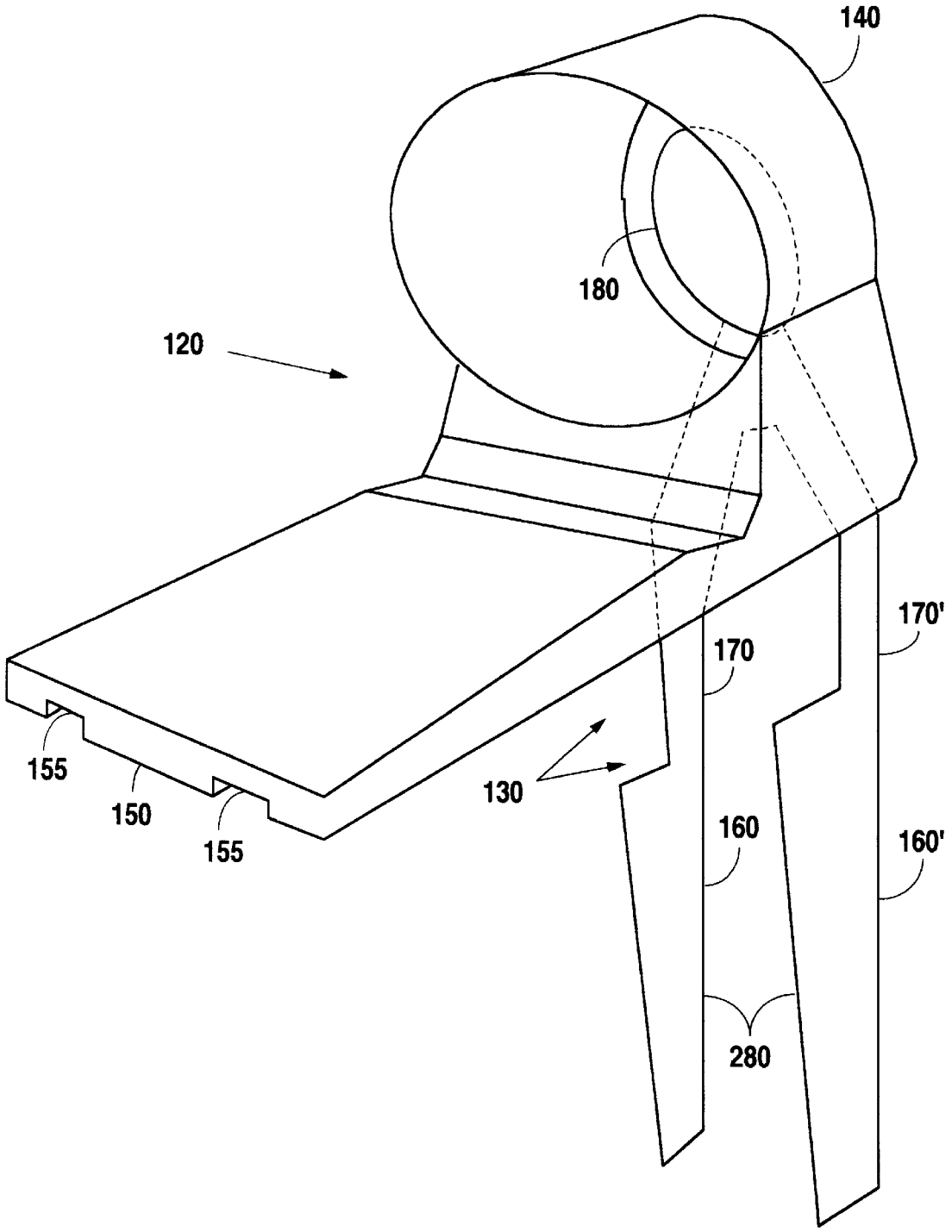
FIG. 11 is a perspective view of an alternative embodiment of the self-deploying rudder assembly of the present invention.

Alternative embodiments of the invention include employing dual rudder blades 280, as shown in FIG. 11. In this implementation, a first and second rudder shaft 170, 170' can be attached to the first and second rudder blades 160, 160', respectively. The thrust plate 180 and pivoting action of the rudder blade assemblies 130 operate in the same manner as described above. Dual grooves 155 in the storage skeg 150 accommodate the rotor blades 160, 160' when the rudder blade assemblies 130 move into the stored position. The use of dual rudders 280 increases the effective rudder surface area and provides more efficient steering characteristics for the water craft 100.

The invention may include a water craft 100 attached to the self-deploying rudder assembly 50 as a complete apparatus for recreational operation on the water, or the invention may be considered as the self-deploying rudder assembly 50 alone. The assembly 50 is a simple, yet effective, auxiliary rudder device for water craft and other vehicles which make use of an exhaust port which includes an exhaust stream operating at various selected thrust levels. The design, using a tension spring or rubber band deployment means 210 maintains the rudder blade 160 in a deployed, functional position when the water craft is idling, or during low speed operations. This is especially useful in emergency situations, wherein throttle operation is typically reduced in an immediate fashion, and the need for steering in an effective manner remains. The natural tendency of the water craft operator to release the throttle lever and steer to avoid obstacles in emergency situations, such as impending collisions, is thereby augmented using the self-deploying rudder assembly 50. Further safety advantages include the use of rudder blades 160 which operate substantially directly below the nozzle 110 of the water craft 100 when deployed, and which remain in a storage skeg 150 when stored. Thus, the rudders are not available to injure swimmers which may come in to close proximity of the water craft 100 during high speed operations. Passengers and/or operators falling off of the water craft 100 during high speed operations are likewise relatively safe from contact with the rudder blades 160. The first class lever or rudder shaft 170, used by the present invention is in direct contrast to other designs which make use of third class levers, and which are relatively unsafe.

Figure 12A:
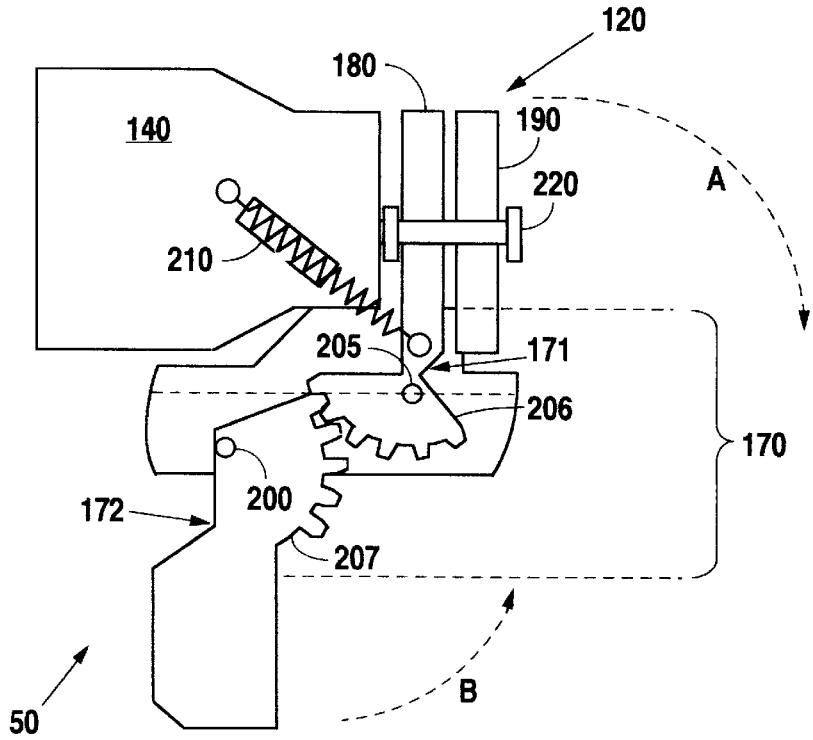
FIGS. 12A and 12B are side views of alternative embodiments of the self-deploying rudder assembly of the present invention.
Figure 12B:
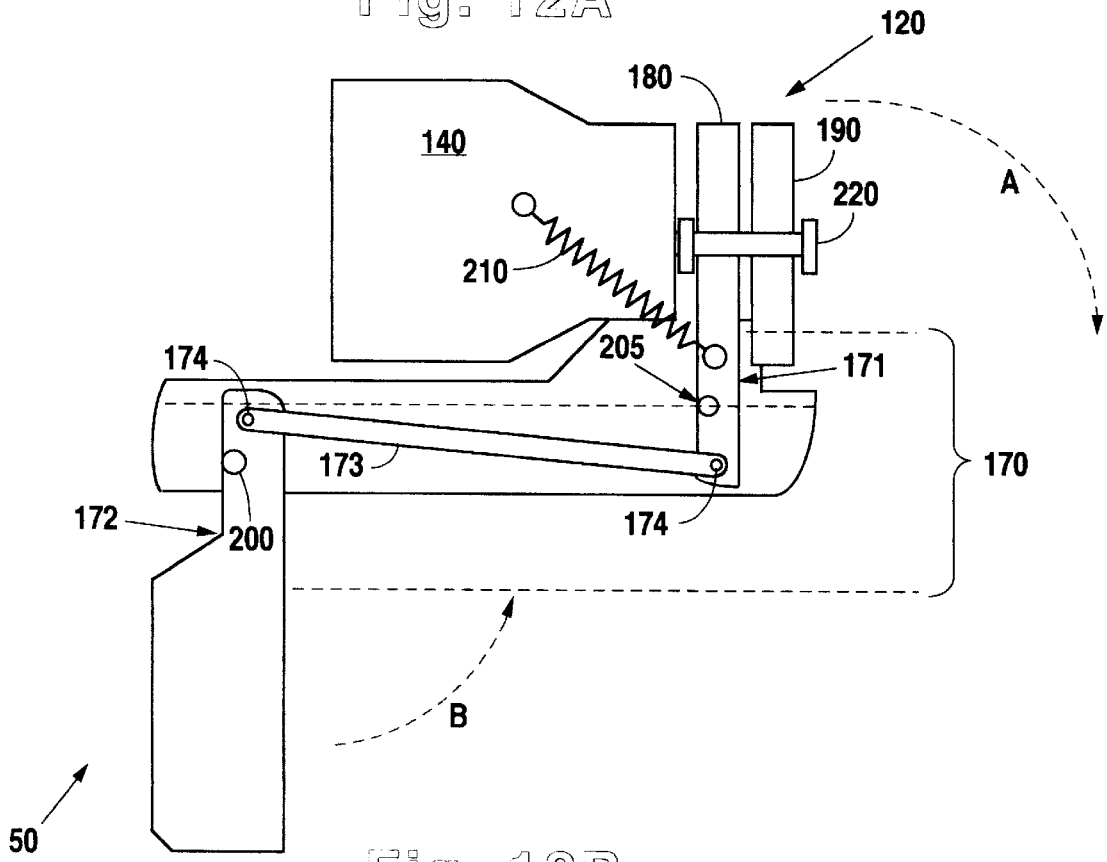

Another possible implementation of the invention can be seen in FIGS. 12A and 12B. Here, the rudder shaft 170 is divided into two parts: an upper shaft 171, and a lower shaft 172. The shaft 170, thus divided, is operated as an integral unit by means of a pair of interlocking gears (see FIG. 12A), the plate gear 206, and the rudder gear 207. Alternatively, the shaft 170 can be divided as shown in FIG. 12B, wherein the upper shaft 171 and the lower shaft 172 are attached or connected to a pushrod 173 using pivot points 174, such as rivets, screws, shafts and bushings, etc. While the rudder blade 160 continues to pivot about the rudder pivot 200, the upper shaft 171 now pivots about the plate pivot 205. Thus, when the exhaust stream thrust level is below the preselected thrust level designated by the operator of the water craft, the self-deploying rudder assembly 50 of the present invention maintains the configuration shown in FIGS. 12A and 12B. However, as the selected thrust level increases above the preselected thrust level, the rudder blade 160 will move in the "B" direction. The upper shaft 171, along with the thrust plate 180 and thrust plate adjuster 190, will move in the "A" direction out of the exhaust stream. In this stored position, the rudder blade will lie substantially beneath the thrust plate 180, which positioning serves a dual purpose. First, the rudder blade 160 will normally be urged into the storage groove 155 by increasing water flow pressure as the water craft operates at higher speeds. Second, the rudder blade 160 will typically not extend beyond the end of the thrust plate 180, so that no additional hazard is presented toward operators and passengers of the water craft.

Figure 13:
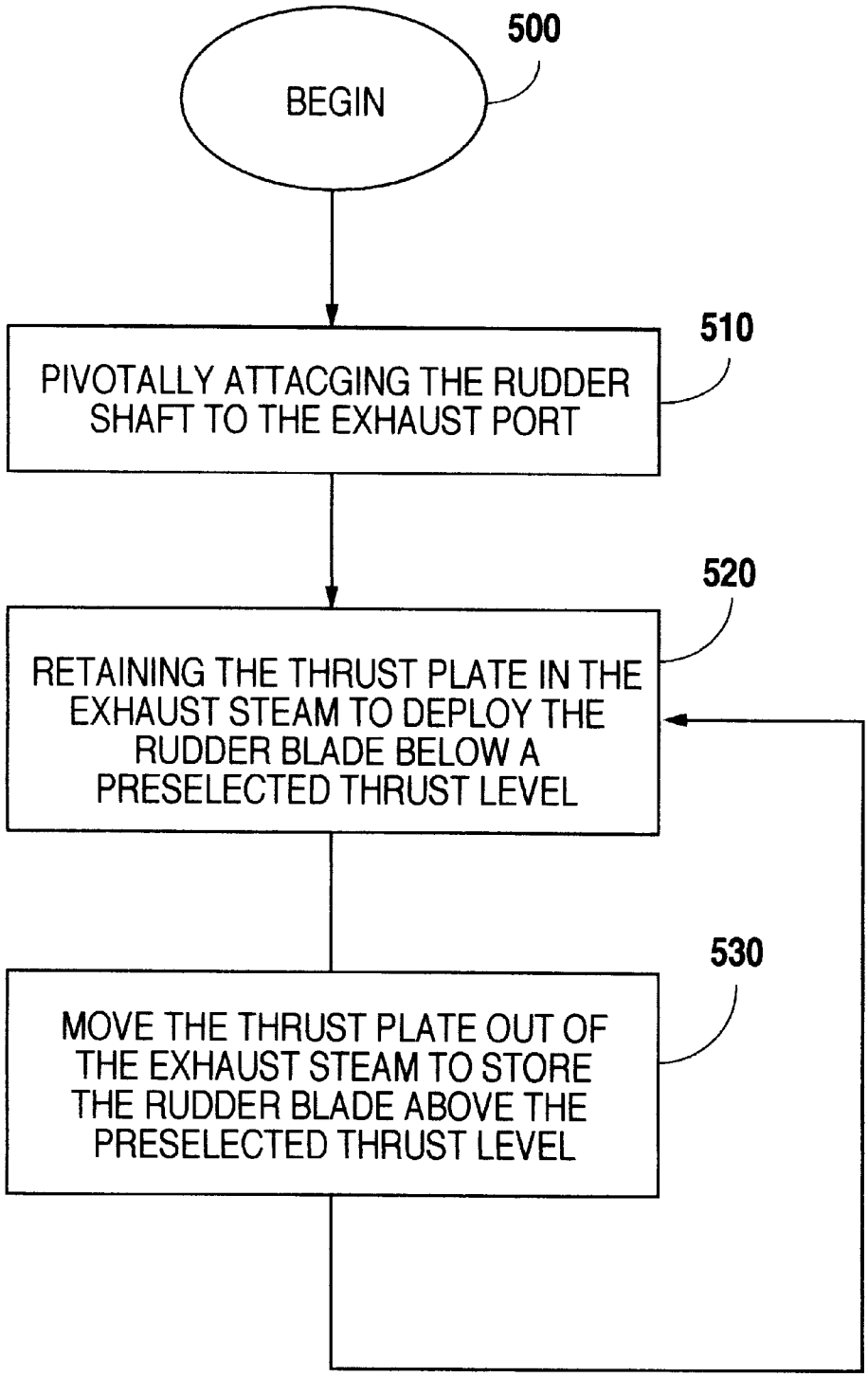
FIG. 13 illustrates a flow chart of the method of the present invention.

The method of deploying a pivoting rudder blade assembly is shown in FIG. 13. It is assumed that the rudder blade assembly includes a rudder shaft with a first end attached to a thrust plate, and a second end attached to a rudder blade using an exhaust port including an exhaust stream exiting the exhaust port at a selected thrust level, the method begins at step 500 and includes the steps of pivotally attaching the rudder shaft to the exhaust port 510, retaining the thrust plate within the exhaust stream so that the rudder blade is in a deployed position so long as the selected thrust level is below a preselected thrust level 520, and moving the thrust plate out of the exhaust stream so that the rudder moves to a stored position when the selected thrust level is above the preselected thrust level 530, typically the rudder blade lies substantially beneath the exhaust port when in the stored position. Throughout the method the rudder blade assembly typically operates as a first class lever, as described above, and repeats steps 520 and 530. However, as illustrated in FIG. 12, the rudder blade assembly is not necessarily operated as a first class lever in every case.

Although the invention has been described with reference to specific embodiments, this description is not meant to be construed in a limited sense. The various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention, or their equivalents.

What is claimed is:

1. A self-deploying rudder assembly for use with an exhaust port including an exhaust stream exiting the exhaust port at a selected thrust level, said self-deploying rudder assembly comprising:

a mounting assembly for attaching the self-deploying rudder assembly to the exhaust port;

a rudder blade assembly pivotally attached to said mounting assembly;

a thrust plate constructed and arranged to intercept the exhaust stream, said thrust plate including at least one orifice having a variable surface area;

a rudder shaft having a first end connected to said rudder blade assembly and a second end connected to said thrust plate assembly;

whereby said rudder blade assembly is caused to pivotally move under the exhaust port to a stored position when the thrust level on said thrust plate is above a pre-selected level.

2. The self-deploying rudder assembly of claim 1 further including:

a skeg attached to said mounting assembly.

3. The self-deploying rudder assembly of claim 2, wherein said skeg includes a groove constructed and arranged to receive said rudder blade in its stored position.

4. The self-deploying rudder assembly of claim 1 wherein said rudder shaft is divided into an upper shaft and a lower shaft connected by a pair of interlocking gears.

5. The self-deploying rudder assembly of claim 4 wherein:

a rudder shaft gear is attached to said upper shaft; and a gear rack is rotatably engaged with said rudder shaft gear.

6. The self-deploying rudder assembly of claim 1 wherein said rudder shaft is divided into an upper shaft and a lower shaft connected by a pushrod.

7. The self-deploying rudder assembly of claim 1 wherein said stored position of said rudder blade is substantially beneath said thrust plate.

8. The self-deploying rudder assembly as defined in claim 1 further including deployment means to move said rudder blade assembly out of said stored position when the thrust level on said thrust plate is below a preselected level.

9. The self-deploying rudder assembly of claim 8 wherein said deployment means is a spring.

10. An apparatus for recreational operation in water comprising:

a water craft having an exhaust port including an exhaust stream exiting the exhaust port at a preselected thrust level;

a self-deploying rudder assembly attached to said water craft, said self-deploying rudder assembly including:

a mounting assembly for attaching said self-deploying rudder assembly to said exhaust port;

a rudder blade assembly pivotally attached to said mounting assembly;

a thrust plate constructed and arranged to intercept said exhaust stream, said thrust plate including at least one orifice having a variable surface area;

a rudder shaft having a first end connected to said rudder blade assembly and a second end connected to said thrust plate assembly;

whereby said rudder blade assembly is caused pivotally to move under the exhaust port to a stored position when said thrust level on said thrust plate is above a pre-selected level.

11. The apparatus of claim 10 wherein said stored position of said rudder blade is substantially beneath said thrust plate.

12. The self-deploying rudder assembly as defined in claim 10 further including deployment means to move said rudder blade assembly out of said stored position when the thrust level on said thrust plate is below a preselected level.

13. The apparatus of claim 11 wherein said rudder shaft is divided into an upper shaft and a lower shaft connected by a pair of interlocking gears.

14. The apparatus of claim 13 wherein:

rudder shaft gear is attached to said upper shaft; and a gear rack is rotatably engaged with said rudder shaft gear.

15. The apparatus of claim 10 wherein said rudder shaft is divided into an upper shaft and a lower shaft connected by a pushrod.

* * * * *